US006435892B1

(12) United States Patent
Billman

(10) Patent No.: US 6,435,892 B1
(45) Date of Patent: Aug. 20, 2002

(54) ELECTRICAL CONNECTOR WITH A SUPPORTING MECHANISM

(75) Inventor: Timothy B. Billman, Dover, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/893,810

(22) Filed: Jun. 27, 2001

(51) Int. Cl.[7] ..... H01R 13/62

(52) U.S. Cl. ..... 439/260

(58) Field of Search ..... 439/260, 259, 439/267, 62, 636, 637

(56) References Cited

U.S. PATENT DOCUMENTS 3,130,351 A * 4/1964 Giel
3,665,370 A * 5/1972 Hartmann ..... 439/260
4,556,268 A * 12/1985 Noschese ..... 439/267

* cited by examiner

*Primary Examiner*—Gary F. Paumen
(74) *Attorney, Agent, or Firm*—Wei Te Chung

(57) ABSTRACT

An electrical connector (1) is adapted for establishing an electrical and mechanical connection between two PCBs (2, 3) and comprises an insulative housing (10) defining a cavity (12) and a number of passageways (16), a terminal module (20) and a number of conductive contacts (30) accommodated into the cavity and the passageways from underside of the housing, respectively. The terminal module forms at least one pivot lug (28) to be received in a receiving slot (18) defined in the housing, and is swivelable about the pivot lug toward or away from the contacts inserted into the housing for connecting or disconnecting the two PCBs. A metal supporting mechanism (40) defines a central opening (43) to receive the pivot lug and forms a pair of retaining arms (42) to be interferingly engaged with the receiving slot, thereby securely supporting the pivot lug in a predetermined position during its swiveling.

1 Claim, 5 Drawing Sheets

ELECTRICAL CONNECTOR WITH A SUPPORTING MECHANISM

BACKGROUND OF THE INVENTION

1. Field of the Invention

The present invention relates to an electrical connector, and particularly to an electrical connector which is provided with a supporting mechanism for supporting a swivelable terminal module thereof in a dielectric housing thereof.

2. Description of Prior Art

With the development trend in computers, connectors which are designed for transmitting high speed signals or logics, such as backplane connectors, serial ATA connectors and so on, are becoming more and more popular, and industry businesses are developing such electrical connectors to meet this requirement. The backplane connector is adapted for electrically and mechanically connecting or disconnecting two PCBs which are oriented essentially perpendicularly with respect to each other. One of the two PCBs is a first insert card which is perpendicularly plugged with respect to the other second board named as a backplane to motherboard.

Referring to U.S. Pat. No. 6,206,713 B1, a backplnae connector disclosed therein has a dielectric housing and two connector halves retained in the housing. The connector halves can be swiveled toward each other and away from each other about a pivot lug which is retained in a recessed section defined in the housing. In a mounting position, they are swiveled away from each other, the connector halves allow the insertion of the first insert card. In a connected position, the connector halves are swiveled toward each other to connect the insert card to the second backplane on which the connector is mounted. Therefore, how to securely support the pivot lug in a predetermined position so as to steadily rotate the connector halves is an important issue, otherwise the pivot lugs will be slide or offset during swiveling, thereby adversely effecting electrical and mechanical connection between the two PCBs. However, the above-mentioned invention does not disclose an effective means to support the pivot lug in a predetermined position. Hence, a backplane connector having an improved supporting mechanism for supporting the pivot lug in a predetermined position is desired to overcome the disadvantage of the prior art.

BRIEF SUMMARY OF THE INVENTION

A main object of the present invention is to provide an electrical connector having a supporting mechanism adapted for securely supporting a terminal module thereof in a dielectric housing of the connector;

A minor object of the present invention is to provide an electrical connector having a supporting mechanism which is easy to manufacture and low in cost.

To fulfill the above-mentioned objects, an electrical connector in accordance with the present invention is adapted for establishing an electrical connection between two PCBs which are oriented essentially perpendicularly with respect to each other. The electrical connector comprises an insulative housing which defines a cavity and a plurality of passageways communicating with the cavity both extending through a bottom face thereof, a rotatable terminal module and a plurality of conductive contacts respectively accommodated into the cavity and the passageways from underside of the housing. The terminal module is formed with at least one pivot lug to be retained in a receiving slot defined in the housing. The terminal module is swivelable about the pivot lug toward or away from the contacts inserted in the housing for connecting or disconnecting with the two PCBs. A supporting mechanism is a "U" shaped metal plate and is formed with a pair of retaining arms defining an opening therebetween to be engageble with the pivot lug. Each retaining arm forms a retaining ear and a retaining tab extending in opposite directions from opposite ends thereof for interferingly abutting against two opposite side faces of the receiving slot, thereby securely supporting the pivot lug in a predetermined position during its swiveling.

Other objects, advantages and novel features of the invention will become more apparent from the following detailed description of the present embodiment when taken in conjunction with the accompanying drawings.

DETAILED DESCRIPTION OF THE INVENTION

Figure 1:
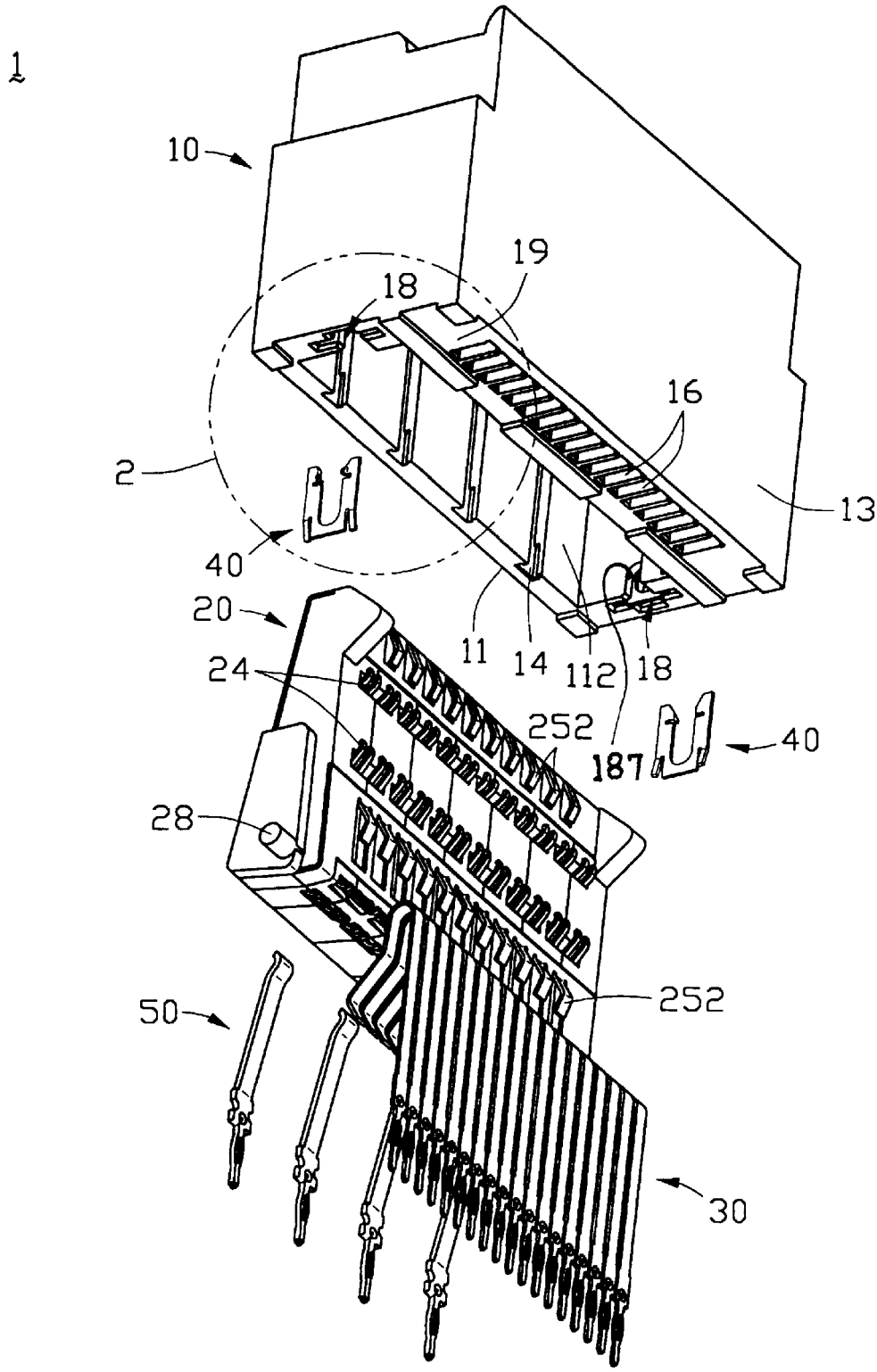
FIG. 1 is an exploded perspective view of an electrical connector in accordance with the present invention.

Referring now to the figures of the drawings in detail and first, particularly to FIG. 1 thereof, an electrical connector 1, generally named as a backplane connector in accordance with the present invention is shown. The electrical connector 1 is provided for an electrical and mechanical connection between two PCBs that are oriented essentially perpendicularly with respect to each other. One of the two PCBs is a first insert board 2 which is plugged perpendicularly onto a second backplane board 3 (see FIG. 5). The electrical connector 1 comprises a main dielectric housing 10, a swivelable terminal module 20 and a plurality of conductive contacts 30 accommodated into the housing 10, and a pair of supporting mechanisms 40.

Figure 5:
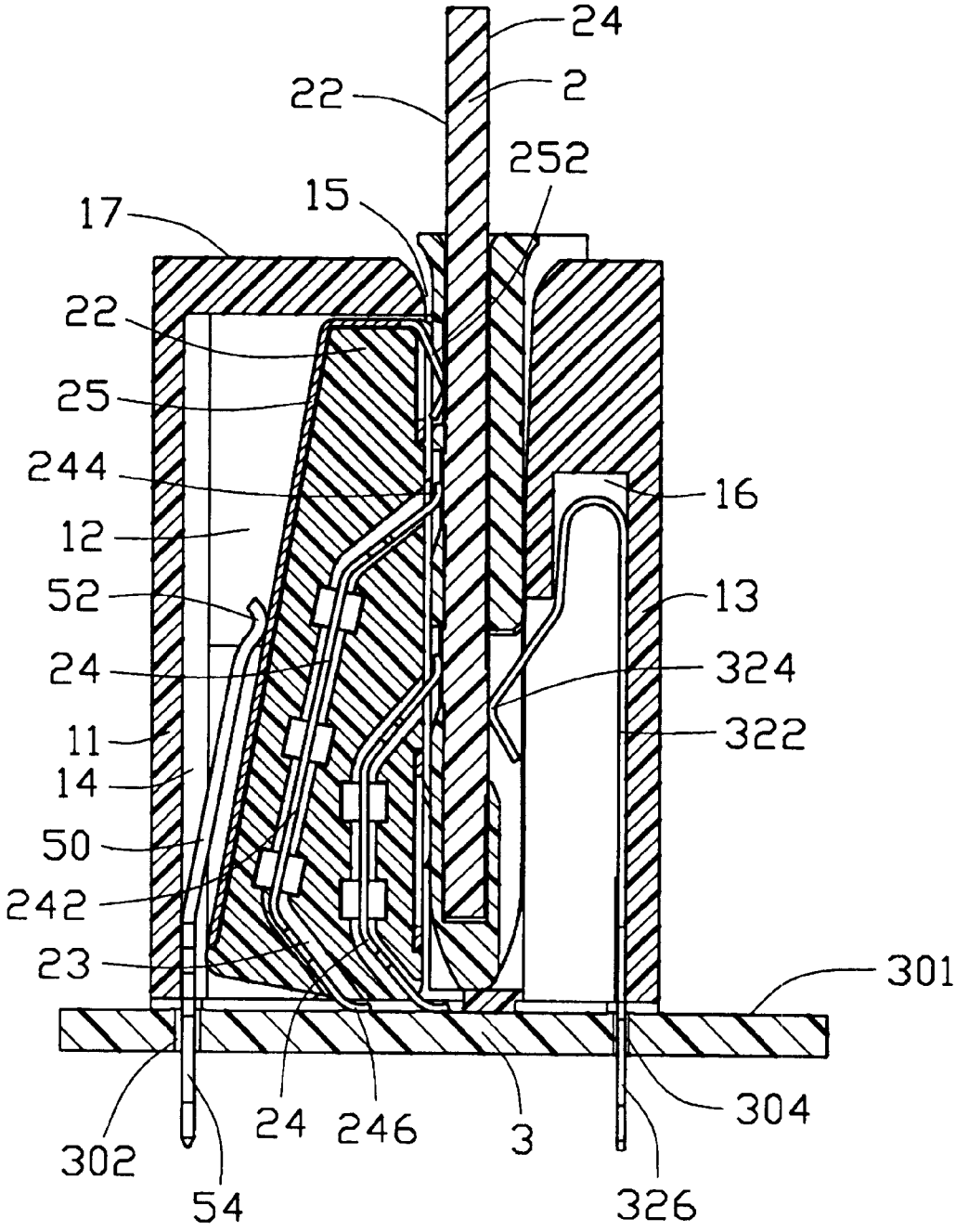
FIG. 5 is a cross-sectional view of FIG. 4 with two PCBs being assembled thereto.

Referring to FIGS. 1 and 5, the dielectric housing 10 defines a cavity 12 extending through a bottom face 19 thereof for receiving the terminal module 20 therein. An opening 15 is defined in a top face 17 of the housing 12 and is communicated with the cavity 12 for insertion of the first board 2. A plurality of longitudinal slits 14 are defined in an inner face 112 of one side wall 11 of the housing 12. The other side wall 13 opposite to the side wall 11 forms a plurality of passageways 16 communicated with the cavity 12 for insertion of the conductive contacts 30. Additionally, the bottom face 19 further defines a pair of receiving slots 18 at opposite ends of the cavity 12. Each receiving slot 18 defines a recessed section 182 in an outer side face 183 thereof and an opening 184 communicating with the cavity 12 in an inner side face 185 thereof.

Referring again to FIGS. 1 and 5, the terminal module 20 is swivelable about a pivot lug 28 thereof between a mounting or relaxed position and a connected position. In the mounting or relaxed position, in which the terminal module 20 is swiveled away from the conductive contacts 30 inserted in the housing 10, the first board 2 is allowed to be inserted between the terminal module 20 and the conductive contacts 30 inserted in the housing 10. In the connected position, in which the terminal module 20 is swiveled toward the conductive contacts 30, the terminal module 20 and the contacts 30 will make an electrical and mechanical connection between the two boards 2, 3. The terminal module 20 comprises a dielectric body 22 and two rows of first upper and lower conductive terminals 24 retained in the dielectric body 22 for transmitting high speed signals between the two boards 2, 3. Each terminal 24 comprises a retaining portion 242 retained in a corresponding channel 23 defined in the dielectric body 22 and first and second contact portions 244, 246 extending out of the dielectric body 22 from opposite ends of the retaining portion 242 for conductively contacting signal pads (not shown) on one side surface 22 of the first board 2 and a top face 301 of the second board 3, respectively. A metal grounding plate 25 is covered on the dielectric body 22 and forms two rows of upper and lower contacting tabs 252 for conductively contacting grounding pads (not shown) of the first board 2. Furthermore, a plurality of grounding terminals 50 are retained in the corresponding slits 14 of the housing 10 and each forms a grounding contact portion 52 for conductively contacting the grounding plate 25 and a press-fit tail 54 press-fitted into a corresponding first hole 302 of the second board 3, thereby establishing a grounding circuit between the two boards 2 and 3. The dielectric body 22 further forms a pair of pivot lugs 28 (only one shown) about which the terminal module 20 is rotatable toward or away from the first board 2. The pivot lugs 28 extend outward from lower portions of opposite ends of the body 22 to be retained in corresponding recessed sections 182 of the receiving slots 18 of the main housing 10.

The conductive contacts 30 are disposed in series alongside one another for transmitting low speed signals between the two boards 2 and 3. Each contact 30 is formed with a retaining section 322 retained in the passageway 16. A curved contact section 324 extends from an upper end of the retaining section 322 into the cavity 12 for conductively contacting signal pads (not shown) on the other side surface 24 opposite to the side surface 22 of the first board 2. A press-fit tail section 326 extends from a lower end of the retaining section 322 for insertion into a corresponding second hole 304 of the second board 3.

Figure 2:
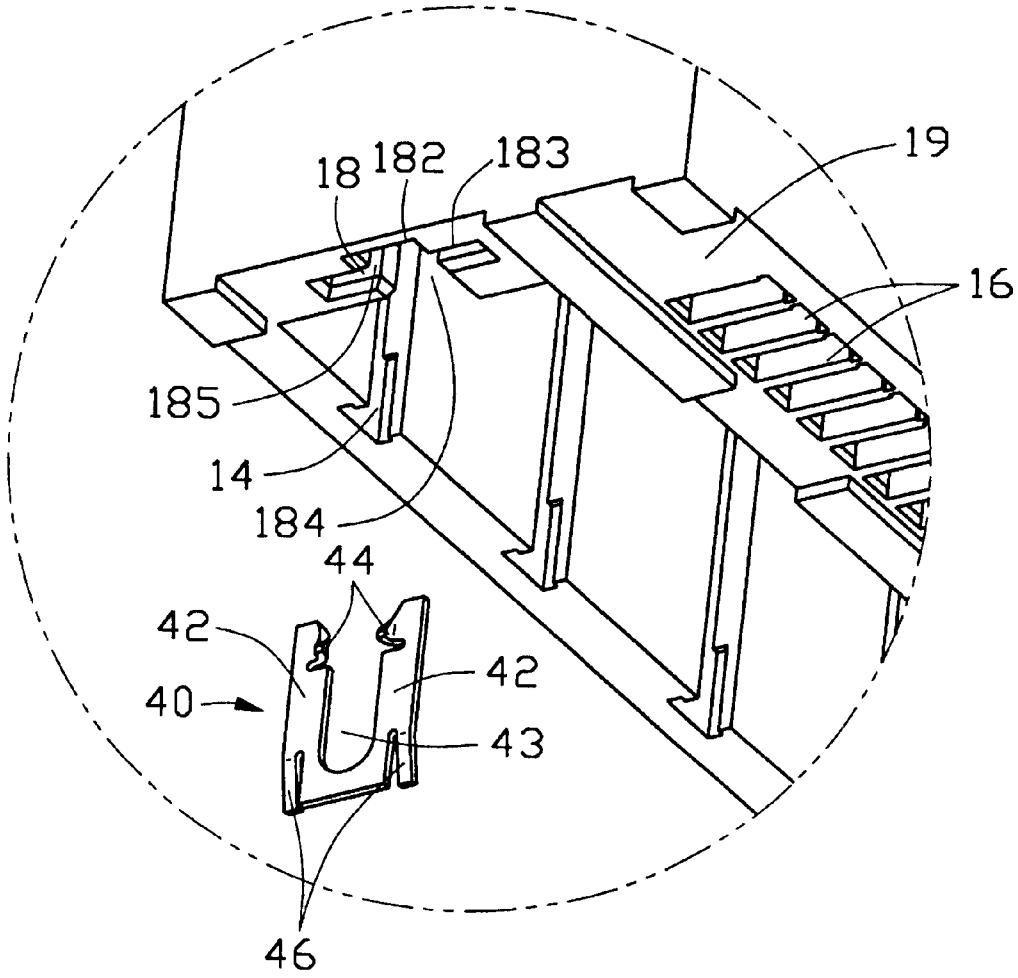
FIG. 2 is an enlarged view taken on a circle identified by reference number 2 in FIG. 1.
Figure 3:
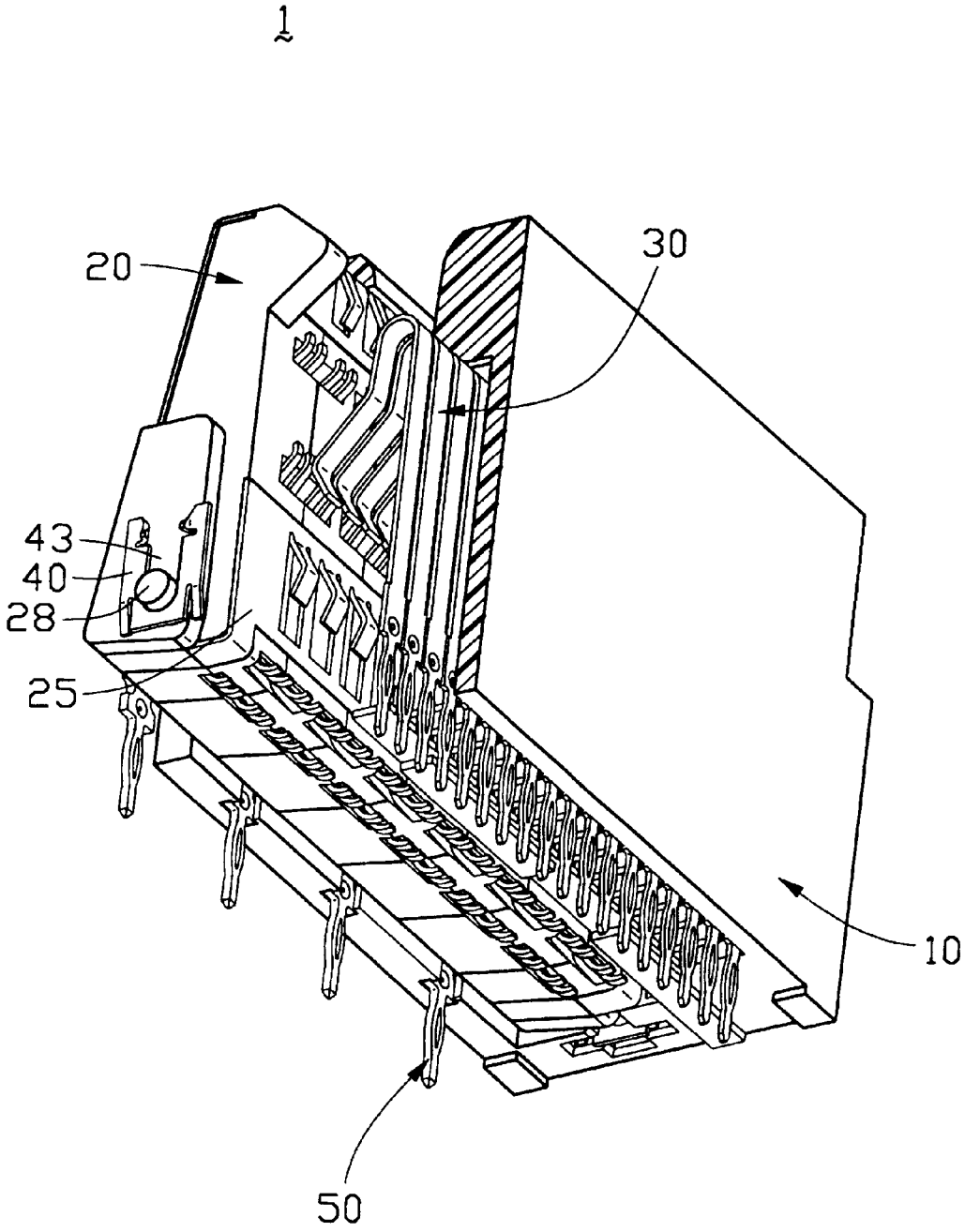
FIG. 3 is a partial cross-sectional assembled view of FIG. 1 view.
Figure 4:
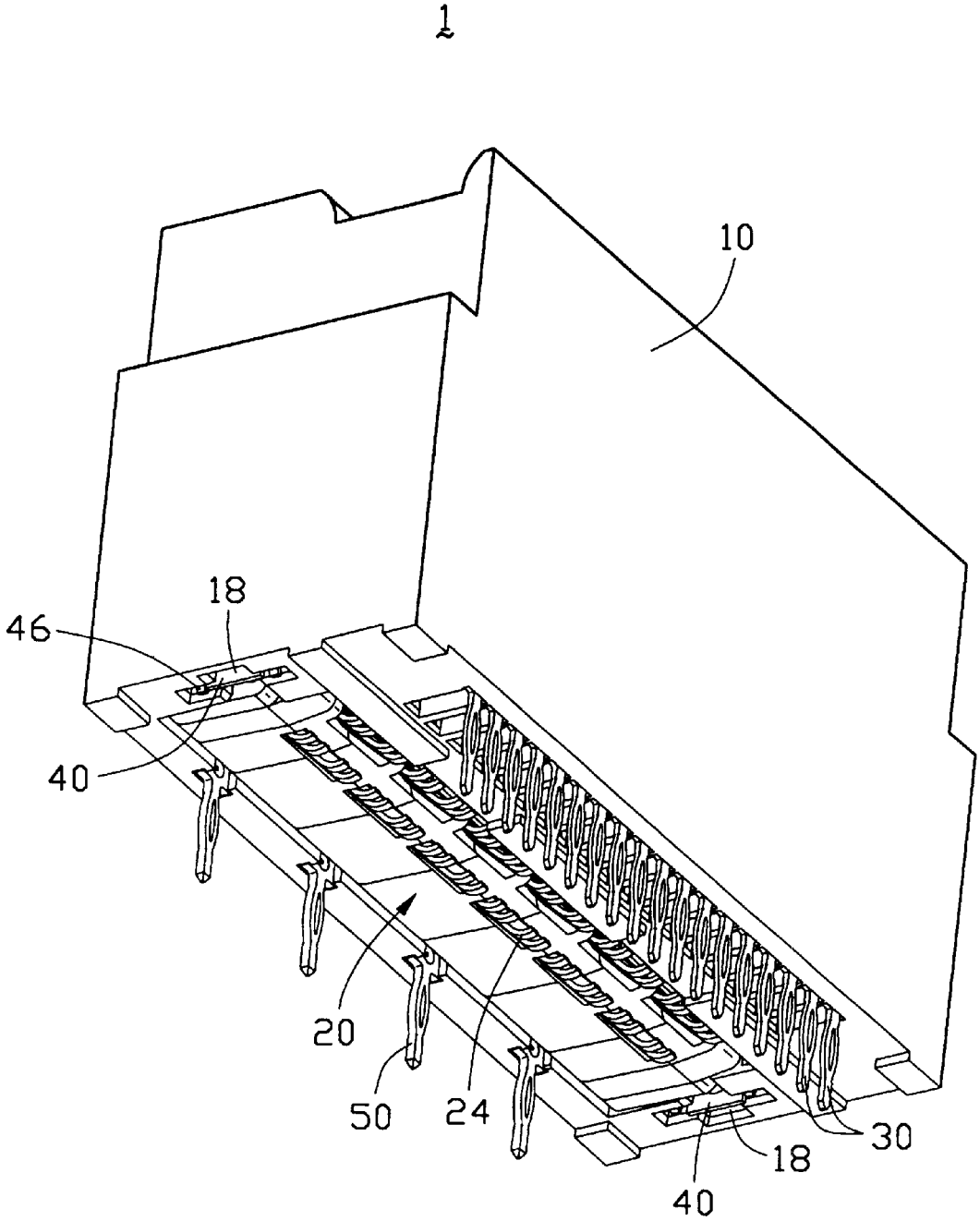
FIG. 4 is an assembled view of FIG. 1.

Referring to FIG. 2, the pair of supporting mechanisms 40 are made of metal material with predetermined resiliency and have symmetric structures with respect to each other, and thus only one is described below. The supporting mechanism 40 has a "U" shape and is formed with a pair of retaining arms 42 defining a central opening 43 therebetween for interferingly receiving the corresponding pivot lug 28 of the terminal module 20, as best seen in FIG. 3. A pair of retaining ears 44 extend outward from upper portions of the retaining arms 42 and a pair of retaining tabs 46 extend inward opposite to the retaining ears 44 from lower portions of the retaining arms 42. The width between the retaining ears 44 and the retaining tabs 46 are slightly larger than the distance between the opposite outer and inner side faces 183, 185 of the receiving slot 18.

In assembly, referring to FIGS. 1 to 5, the terminal module 20 and the conductive contacts 30 are inserted into the cavity 12 and the passageways 16 from the underside of the housing 10, respectively. At the same time, the pivot lugs 28 of the terminal module 20 are interferingly inserted into the recessed sections 182 of the corresponding receiving slots 18. The grounding terminals 50 are then inserted into corresponding slits 14 from the underside of the housing 10. Each supporting mechanisms 40 is interferingly inserted into a corresponding receiving slot 18 from the underside of the housing 10 due to its resiliency, and the opening 43 thereof is fitted with a corresponding pivot lug 28 of the terminal module 20. Also, the retaining ears 44 and tabs 46 of the supporting mechanism 40 are interferingly abutted against the outer and inner side faces 183 and 185 of the receiving slot 18, respectively. With this design, the supporting mechanisms 40 securely retain the pivot lugs 28 of the terminal module 20 in the predetermined position without any offset or movement during its rotating, thereby ensuring an effective mechanical and electrical connection between the two PCBs 2, 3. Understandably, the housing may optionally form an inverse U-configuration 187 around the receiving slot 18 to restrict upward movement of the pivot lug 28 in the housing 10.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for electrically connecting a first printed circuit board (PCB) to a second PCB, said electrical connector comprising:

an insulative housing defining a cavity, a plurality of passageways communicating with the cavity and a pair of receiving slots at opposite ends of the cavity;

a terminal module and a plurality of second conductive contacts being accommodated into the cavity and corresponding passageways of the housing, respectively, the terminal module having a dielectric body and a plurality of conductive terminals retained in the dielectric body, each of the conductive terminals and the conductive contacts having two opposite contact sections for conductively contacting the first and second PCBs, respectively, the terminal module being formed with a pair of pivot lugs about which the terminal module is swivelable toward or away from the conductive contacts inserted in the housing; and at least one supporting mechanism being interferingly retained in the receiving slot and defining an opening engageble with a corresponding pivot lug for swivelably supporting the terminal module.

* * * * *